United States Patent [19]

Georgiades

[11] 4,352,670

[45] Oct. 5, 1982

[54] CONVERTING MACHINE GUM BOX

[75] Inventor: Gregory Georgiades, Longmeadow, Mass.

[73] Assignee: Westvaco Corporation, New York, N.Y.

[21] Appl. No.: 193,909

[22] Filed: Oct. 6, 1980

[51] Int. Cl.[3] ..... B05C 1/06

[52] U.S. Cl. ..... 493/337; 118/259; 118/602

[58] Field of Search ..... 493/337, 336, 331, 281, 493/280, 279, 278, 132, 131, 266, 150; 118/259, 258, 261, 602, 612

[56] References Cited

U.S. PATENT DOCUMENTS

| | | | |
|---|---|---|---|
| 571,527 | 11/1896 | Honiss et al. | 118/262 |
| 2,568,629 | 9/1951 | Heywood | 493/266 |
| 2,641,220 | 6/1953 | Weber et al. | 118/259 |
| 2,731,945 | 1/1956 | Schaefer | 118/246 |
| 3,063,408 | 11/1962 | Gustafson et al. | 118/602 X |
| 3,294,060 | 12/1966 | McIntyre et al. | 118/261 |
| 3,339,485 | 9/1967 | Rytterholm | 101/363 |

*Primary Examiner*—James F. Coan

*Attorney, Agent, or Firm*—W. Allen Marcontell; Richard L. Schmalz

[57] ABSTRACT

A rotary converting machine gum box is replenished with adhesive by means of a pumped circulation system which includes a first pump delivery conduit at one end of the gum box and a second pump suction conduit at the other end. A small adhesive pond or trough region between the two gum box ends carries the adhesive flow from one end to the other parallel to the meter roll surface and in flooding contact therewith. Adhesive pond level within the gum box is regulated by a speed differential between the two pumps thereby regulating the relative supply and withdrawal rates of the two pumps.

7 Claims, 2 Drawing Figures

CONVERTING MACHINE GUM BOX

BACKGROUND OF THE INVENTION

1. Field of the Invention

The present invention relates to paper or sheet product converting machines of the rotary type wherein a serial multiplicity of cutting, scoring, folding and gluing operations are performed on sheet material such as paper drawn from a reel of indefinite length to produce a finished product.

More particularly, the subject invention relates to an improvement in gum box apparatus used as a subcombination element in a rotary converting machine.

2. Description of the Prior Art

The generally practiced prior art technique of applying gum adhesive to precisely designated areas of a paper sheet product blank in transit through a rotary converting machine is to print the gum onto the blank by a rotary image transfer means called a picker as the blank passes between the picker carrying roll and a backing roll. U.S. Pat. No. 2,568,629 to V. E. Heywood is representative of the prior art as presently practiced with a rotary envelope machine.

Relative to the Heywood disclosure, gum adhesive is applied to the picker print face from the surface of a rotating metering roll in the same manner as practiced by the rotogravure arts. A portion of the rotating meter roll periphery is immersed in a viscous, fluidized gum bath. A doctor blade skims the 1000 to 3000 centipoises viscosity film adhering to the meter roll surface to leave a thinner film of gum having a precisely graduated thickness remaining on the roll surface. Continued rotation of the meter roll past the doctor blade brings the doctored gum film into contact with the print face of the picker which, by viscous fluid adhesion, picks that portion of the film off the meter roll surface onto the picker print face.

As the picker roll continues rotation path tangency with the meter roll and into tangency with a backing roll, a register aligned envelope blank is drawn into the nip between the picker and backing roll where gum on the picker print face transfers to the desired location on the envelope surface.

At the current state of art development, envelope machines such as Haywood's are capable of producing up to 1200 envelopes per hour and consume 0.5 gallon per hour of adhesive from a single gum box in the process. Such a fluid consumption rate would normally suggest the utility of an automatically controlled, pumped supply of adhesive to the gum box.

Although the concept of pumped gum box replenishment, may, under the circumstances, appear obvious, as a practical fact this has not occurred. Gum boxes on high speed rotary converting machines such as Heywood's are predominantly replenished from small, one liter sized, manually changed vessels which dispense their contents by means of a simple, vacuum regulated liquid level control apparatus.

The operative reasons for continued use of such an archiac gum supply system reside in the physical characteristics of the gum and its rheology. For example, the gum solids are dissolved in a highly volatile solvent to permit rapid drying after application to the envelope blank. However, the gum pond through which the meter roll rotates is atmospherically open thereby permitting solvent loss to the atmosphere prior to application on the envelope. The aforedescribed small gum containers represent an effort to minimize the surface area of fluid gum exposed by the gum pond. Although it is desirable to minimize the pond size, the absolute scale required for manual manipulation of a gum supply container necessitates an undesirably large pond.

As a consequence of the gum rheology, the continuous shear of the meter roll surface through the pond tends to upset and thicken the gum viscosity. The adhesive meter roll has a 1:1 rotational ratio with the article production rate; e.g. an envelope production rate of 1200 envelopes per minute requires 1200 meter roll revolutions per minute. Simultaneously, the adhesive viscosity may, representatively, be in the order of 3000 centipoises at 70° F. The meter roll surface draws the thick adhesive fluid to a shear line at the doctor blade which allows a small portion of the adhesive propelled by the roll surface to pass through the blade gap opening. The remaining portion of the moving fluid inertially drives across the pond bottom to be cyclically returned to the meter roll surface. Resultantly, the adhesive pond is, dynamically, in a continuous, rolling circulation and boundary layer shearing. It is the high frequency shearing of the adhesive that upsets the physical rheology of the substance to further increase the viscosity. Consequently, within the rolling circulation of the adhesive pond, flow channels are developed between a single, centrally located, adhesive supply point and the meter roll surface. Such flow channels are bounded by flow stagnation zones wherein the gum eventually gels. The gelatinization is progressive and finally obstructs all flow regions between the source container and the meter roll surface. When this occurs, the machine production must be enterrupted while the gum box is purged of gelatinized gum and thoroughly cleaned.

This latter consequence of gum distribution to the meter roll surface occurs regardless of the gum supply technique; whether by bottle or by pumped replenishment. Since the machine downtime for gum box cleaning represents the major value of operating maintenance losses, there has been little incentive to replace the bottle gum supply system with a pumped system.

It is, therefore, an object of the present invention to teach a rotary converting machine gum box system having a rapidly flowing gum distribution channel between pumped gum supply and withdrawal points in parallel flooding contact with the meter roll surface.

Another object of the present invention is to provide a rotary converting machine gum box with a rapidly circulating pumped replenishment system requiring minimal atmospherically exposed area and infrequent maintenance cleaning.

SUMMARY OF THE INVENTION

These and other objects of the invention are accomplished by means of a pumped adhesive supply system having a first pump drawing from an adhesive reservoir for discharge into a small pond gum box vessel at one end thereof near the juncture of the meter roll surface and the doctor blade. A second pump withdraws adhesive from the gum box at the opposite end thereof through a conduit also positioned near the meter roll-doctor blade juncture. Such withdrawn adhesive is returned to the reservoir.

The two adhesive circulating pumps are adapted for differential volume displacement; whether by speed control or displacement control. One arrangement comprises a variable ratio, differential drive connection from a single power source to the two pumps whereby the speed ratio between the two pumps can be regulated for the purpose of gum box level control.

BRIEF DESCRIPTION OF THE DRAWING

Relative to the drawing wherein like reference characters designate like or similar element throughout the two figures.

DESCRIPTION OF THE PREFERRED EMBODIMENT

Figure 1:
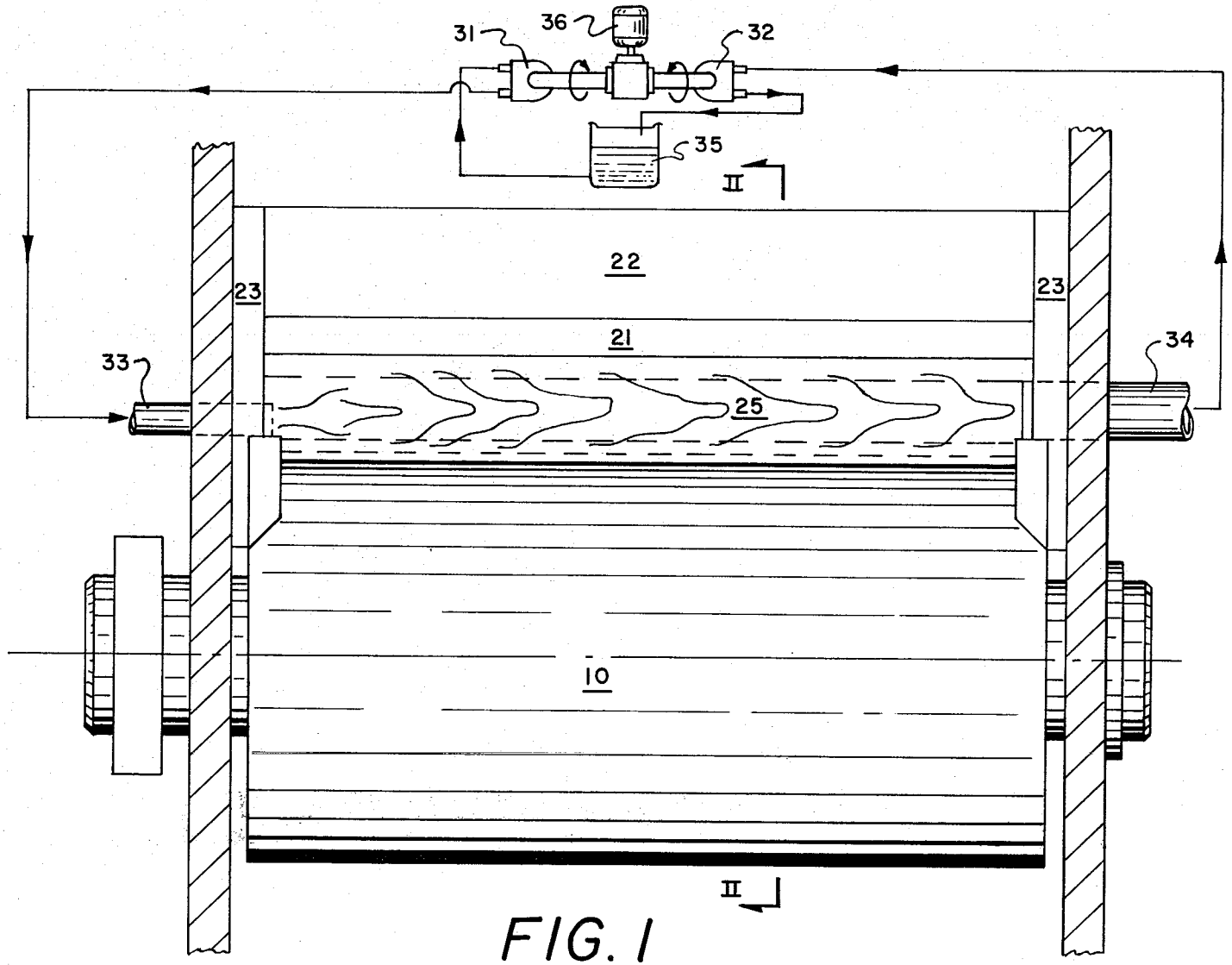
FIG. 1 is a plan view of a gum box apparatus contructed pursuant to the present invention including a schematic diagram of the adhesive circulation system; and, FIG. 2 is a sectional end elevation of a gum box constructed pursuant to the present invention.
Figure 2:
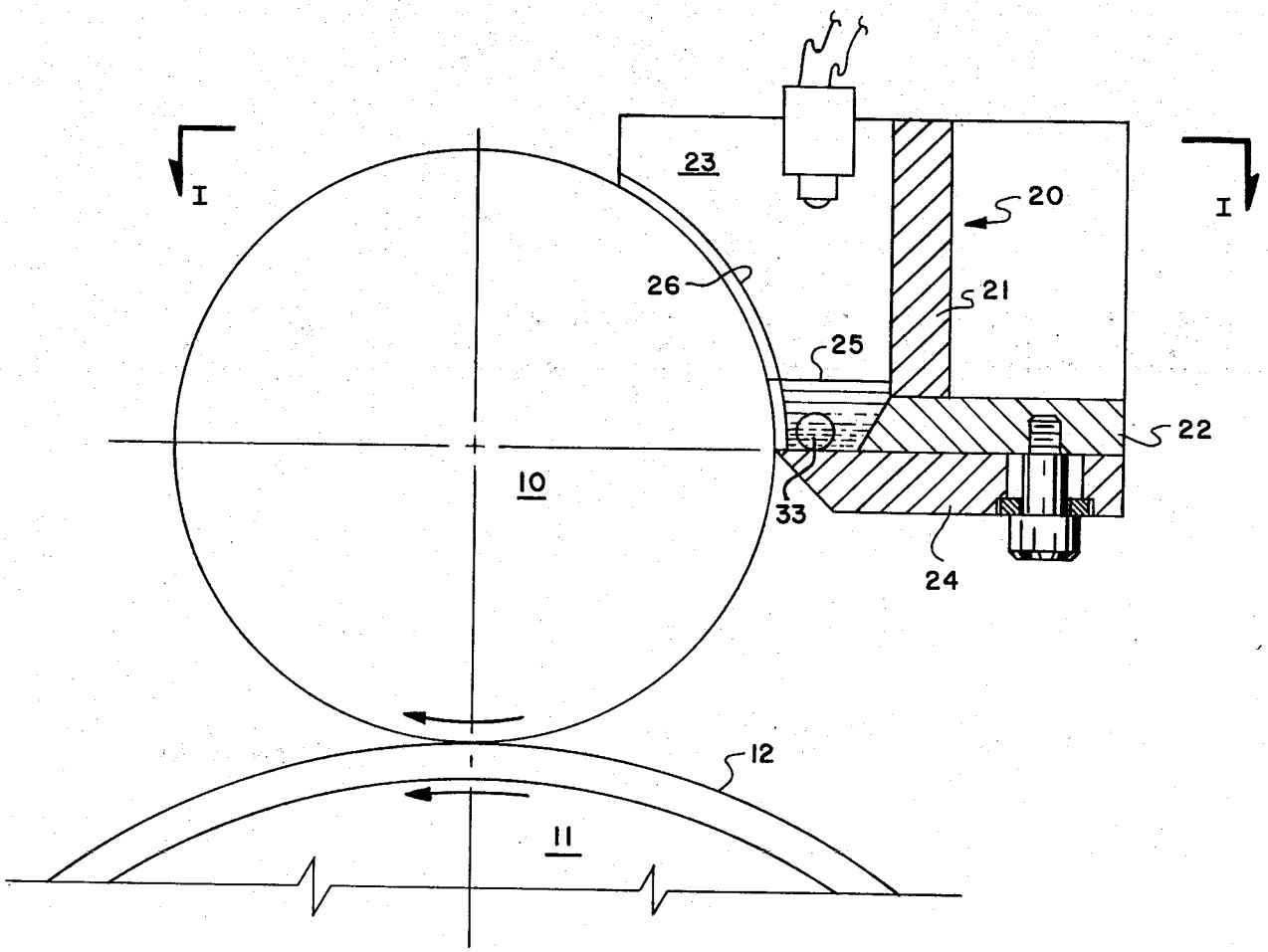

Relative to the drawing, a rotary converting machine to which the invention relates, such as an envelope machine, comprises an adhesive (gum) metering roll 10 rotatively driven up to 1200 rpm in nip coordination with a picker roll 11. An image transfer element 12 secured to the picker roll surface is carried into nip proximity with a thin film of adhesive coating the meter roll surface. Said meter roll film transfers to the image element 12 upon rolling contact therewith. Continued rotation of the picker roll subsequently takes the image element 12 into registered contact with a sheet product blank thereby "printing" the adhesive thereon in the exact position and configuration desired.

The thin adhesive film on the meter roll surface is developed by means of a gum box device 20 which basically comprises a back element 21, a bottom element 22 and side panels 23. An adjustably positioned doctor blade 24 completes the gum box bottom structure to confine a gum pond 25. Sealing shoes 26 secured to the side panels 23 seal the liquid adhesive pond 25 relative to the curved, rotating surface of the meter roll 10.

As the surface of the rotatively driven meter roll 10 rolls into immersion with the standing pond of adhesive 25, it is flood coated. A discrete gap setting between the doctor blade 24 wiping edge and the meter roll surface permits only a desired thickness of film to remain on the roll surface.

Replenishment of the gum box pond 25 occurs by means of a pumped adhesive circulation system including two peristaltic pumps 31 and 32 (FIG. 1) for supply and withdrawal of adhesive relative to the gum box pond 25, respectively, via conduits 33 and 34. Penetration points of the two conduits 33 and 34 through the side panels 23 are located as near the juncture point of the meter roll 10 surface with the doctor blade 24 edge as physically possible. Preferably, the highest extremity of the withdrawal conduit 34 above the doctor blade is set at the desired pond level. For example, a half inch tube may be sufficient for the supply conduit 33 whereas a one inch withdrawal tube 34 may be necessary to meet the liquid level height parameter.

The invention exploits two pumps 31 and 32 driven by a common power source 36 such as an electric motor connected to a variable differential unit 37. Such a differential unit 37 permits the rotational ratio between the two output drive shafts to be selectively altered. Representatively, for two substantially identical pumps, this speed ratio may range from 1:1.1 to 1:2.

The prime motivation for such a drive arrangement is to assure a greater adhesive flow withdrawal capacity than supply: notwithstanding the fact that normally, the adhesive withdrawal volume will be less than the supply only by the amount of consumption. It will be understood by those skilled in the art of pumping viscous adhesives that the supply pump 31, having a positive suction head provided by the adhesive reservoir 35, will have a greater volumetric efficiency than an identical pump 34 driven at the same speed but having a suction pick-up from a low-head trough such as gum box pond 25. By driving two such identical pumps 31 and 32 at a small speed differential, the withdrawal pump 32 being provided the greater speed, assurance is given that the withdrawal pump 32 has the greater pumping capacity (as opposed to delivery) than the supply pump 31. Under such circumstance, if the pond 25 level rises above the pond opening of withdrawal conduit 34, both pumps 31 and 32 are operating at near optimum volumetric efficiency. Pursuant to the invention, under such circumstances, pump 32 will withdraw more adhesive than pump 31 can supply thereby reducing the pond 25 level height until such level height falls below the opening height of conduit 34. When this occurs, the pump 34 will begin drawing air thereby breaking the pump suction and reducing the volumetric efficiency and displacement.

For assurance that the self-regulating pond level arrangement just described does not malfunction to overflow the pond 25, a co-axial reflective photosensor 40 is positioned above the pond to energize a relay for interrupting power to the supply pump 31 in the event that the pond level rises above a predetermined maximum.

Having fully described the preferred embodiment of my invention, variations thereto will readily occur to those skilled in the art. For example, rather than use a variable differential 37 to drive the two identical pumps 31 and 32 at respective speeds, it is equally practical to direct drive one pump and extract power for the other pump from the direct connection shaft between the motor 36 and the one pump by means of a belt or chain with a reduction sheave or sprocked in the transmission link. Similarly, the two pumps 31 and 32 may both be directly driven: one with a variable speed motor set at a different speed than the other, constant speed motor.

Another obvious alternative is to differentially size the two pumps 31 and 32 and direct drive both at the same speed; the larger capacity pump being the withdrawal pump 32.

As my invention, therefore,

I claim:

1. A rotary converting machine gum box comprising back, opposite ends and bottom wall portions disposed longitudinally adjacent an adhesive metering roll, said bottom wall portion also including a doctor blade for the surface of said metering roll, said wall portions and metering roll surface defining a fluid adhesive pond enclosure, the improvement comprising:

A. An adhesive flow delivery conduit at one end wall opening into said enclosure proximate of a juncture between said doctor blade with said metering roll;

B. An adhesive flow withdrawal conduit at the opposite end wall opening into said enclosure proximate of a juncture between said doctor blade with said metering roll; and C. Adhesive flow circulation means connecting said conduits having greater withdrawal flow capacity than delivery capacity.

2. Apparatus as described by claim 1 wherein an opening aperture of said withdrawal conduit extends from the proximity of said doctor blade up to a predetermined liquid level maintenance height.

3. Apparatus as described by claim 1 wherein said flow circulation means comprises first pump means connected to discharge through said delivery conduit and second pump suction means connected with said withdrawal conduit.

4. Apparatus as described by claim 3 wherein said second pump means has a greater volumetric capacity than said first pump means.

5. Apparatus as described by claim 4 wherein said second pump means is driven at a greater speed than said first pump means by a power source common to both pump means.

6. An adhesive supply system for a rotary converting machine gum box having a metering roll surface flooding trough extending parallel to said metering roll surface from substantially on end to the other, said system comprising:

A. Adhesive delivery conduit means opening into said trough in the juncture proximity of said metering roll surface at one end thereof with a doctor blade edge;

B. Adhesive withdrawal conduit means opening into said trough in the juncture proximity of the other end of said metering roll surface and said doctor blade edge;

C. First pump means for delivery flow of adhesive through said delivery conduit means from a reservoir means to said trough; and, D. Second pump means for withdrawal flow of adhesive through said withdrawal conduit means from said trough to said reservoir means, said second pump means having a greater flow capacity than said first pump means.

7. An adhesive supply system as described by claim 6 wherein said withdrawal conduit opening height above said doctor blade edge is greater than said delivery conduit opening height for limiting the depth of adhesive fluid flowing through said trough.

* * * * *

UNITED STATES PATENT OFFICE

CERTIFICATE OF CORRECTION

PATENT NO. : 4,352,670

DATED : October 5, 1982

INVENTOR(S) : Gregory Georgiades

It is certified that error appears in the above-identified patent and that said Letters Patent are hereby corrected as shown below:

Column 3, line 9, "element," should be --elements--. Column 4, line 40, correct the spelling of "sprocket." Column 5, line 18 (Claim 6, line 4), delete "on," insert --one-- therefor.

Signed and Sealed this

Fourth Day of January 1983

[SEAL]

Attest:

GERALD J. MOSSINGHOFF

Attesting Officer

Commissioner of Patents and Trademarks